US005340678A

United States Patent [19]

Suzuki et al.

[11] Patent Number: 5,340,678

[45] Date of Patent: Aug. 23, 1994

[54] DRY TOWER FOR DEVELOPING ELECTROSTATIC IMAGE, PROCESS FOR PRODUCING SAME, AND IMAGE FORMATION METHOD USING SAME

[75] Inventors: Chiaki Suzuki; Atuhiko Eguchi; Yuka Ishihara; Takayoshi Aoki; Seiichi Takagi; Toshiyuki Yano; Masao Mochizuki, all of Minami Ashigara, Japan

[73] Assignee: Fuji Xerox Co., Ltd., Tokyo, Japan

[21] Appl. No.: 84,072

[22] Filed: Jun. 30, 1993

[30] Foreign Application Priority Data

Jul. 2, 1992 [JP] Japan ..... 4-197452
Jul. 2, 1992 [JP] Japan ..... 4-197453

[51] Int. Cl.[5] ..... G03G 9/08; G03G 13/22

[52] U.S. Cl. ..... 430/170; 430/125; 430/126; 430/137

[58] Field of Search ..... 430/110, 125, 126, 137

[56] References Cited

U.S. PATENT DOCUMENTS 5,202,209 4/1993 Winnik et al. ..... 430/110 X

FOREIGN PATENT DOCUMENTS 182660 7/1988 Japan ..... 430/110

*Primary Examiner*—Roland Martin
*Attorney, Agent, or Firm*—Oliff & Berridge

[57] ABSTRACT

A dry toner for developing an electrostatic latent image comprising toner particles and fine particles of a lubricant coated with an inorganic compound fine powder and an image formation method using the same. The toner is excellent in fluidity, cleaning properties, stability with environmental changes, and durability.

12 Claims, 1 Drawing Sheet

DRY TOWER FOR DEVELOPING ELECTROSTATIC IMAGE, PROCESS FOR PRODUCING SAME, AND IMAGE FORMATION METHOD USING SAME

FIELD OF THE INVENTION

This invention relates to a dry toner or a developer composition for development of an electrostatic latent image, a process for producing the same, and a method of image formation by electrophotography, electrostatic recording or the like technique.

BACKGROUND OF THE INVENTION

Electrophotographic dry developers are divided into one-component developers comprising a toner itself containing a binder resin having dispersed therein a colorant and two-component developers comprising a toner and a carrier. In carrying out electrophotographic copying using either type of the developer, an electrostatic latent image formed on a photoreceptor, etc. is visualized with the developer to form a toner image, which is then transferred to a transfer material, such as paper or a sheet and fixed thereon by heat, a solvent, pressure, etc. to furnish a permanent toner image. Thereafter, the photoreceptor is cleaned to remove any remaining toner.

Accordingly, a dry developer is required to satisfy various conditions in each of these copying steps, particularly in the development step or cleaning step. For example, a toner should act as independent particles but not in the form of agglomerates. To this effect, it is required that the toner should have sufficient fluidity and that the flow characteristics or electrical characteristics of the toner should not be subject to variation with time or change in environmental conditions such as temperature and humidity.

In addition, the toner in a two-component developer is required to cause no filming phenomenon, i.e., caking of a toner, on the surface of carrier particles.

After transfer of the toner image to a transfer material, the toner remaining on a photoreceptor should easily be released therefrom by cleaning (cleanability). Where a cleaning member, such as a blade or a web, is used in the cleaning mechanism, the toner should not scratch a photoreceptor on being cleaned off with such a member. These properties of a toner in a cleaning step will hereinafter be inclusively referred to as cleaning properties or cleanability.

For the purpose of improving fluidity, cleaning properties and durability of a dry developer, it has been proposed to add to a one-component or two-component developer various external additives, such as inorganic powders (e.g., silica) and organic powders (e.g., fatty acids and derivatives thereof), and fluorine-containing resin powders.

Of the additives proposed to date, inorganic powders, such as silica, titania, and alumina, considerably improve fluidity of dry developers. However, because of their hardness, they are liable to make recesses or scratches on the surface of a photoreceptor. It follows that toner particles cake on the scratched part of the photoreceptor.

Further, regenerated paper has been steadily extending its use with the aim of resources-saving. In general, regenerated paper produces much paper dust, and the paper dust tends to enter the gap between a photoreceptor and a cleaning blade, causing cleaning defects, such as black streaks.

In order to overcome these problems, external addition of a fatty acid metal salt (as described in JP-B-54-16219 and JP-A-60-198556) or a wax (as described in JP-A-61-231562 and JP-A-61-231563) as a lubricant has been proposed. However, any of these external additives disclosed has a large particle size of from 3 to 20 μm so that it should be added in a considerable amount to be made efficient use of. Besides, although these lubricants are effective in the initial stage, they themselves undergo filming, failing to form a uniform lubricating film, eventually causing image defects, such as white spots and blurs. (The term "JP-A" as used herein means an "unexamined published Japanese patent application", and the term "JP-B" used herein means an "examined Japanese patent publication".)

In particular, where an organic photoreceptor in belt form is cleaned with a rubber blade, a brush, etc. in a high-speed copying machine, cleanability of the organic belt photoreceptor is very unstable due to its distortion or sag unlike a drum photoreceptor. Therefore, cleaning of an organic belt photoreceptor must be carried out under a high load of a blade upon the photoreceptor. Further, the state-of-the-art belt photoreceptors have seams, at which a blade chatters or a blade is scratched to cause poor cleaning. Addition of the above-mentioned lubricating additives to the toner has been examined for applicability to such a belt photoreceptor system. It was revealed as a result that the particles added are easily deformed under strong shearing in every case. That is, the additive is effective in the initial stage under a high load but undergoes filming itself before long to cause white spots, blurs, etc.

JP-B-63-39904 discloses a process comprising treating inorganic compound fine particles with a fatty acid or a fatty acid metal salt. According to this process, the effect on cleaning properties is obtained in the initial stage but eventually weakened because the lipophilic inorganic fine particles are gradually buried in toner particles due to stress by agitation and the like. Further, the treatment for imparting lipophilic nature induces agglomeration of the inorganic fine particles. Although the agglomeration gives rise to no problem in the initial stage, the agglomerated particles will be accumulated in a developing machine or be deposited on the inner wall of a developing machine without being consumed. On exceeding a certain level of accumulation, the agglomerated particles appear on the background of copies as coarse grain fog.

It has been suggested to externally add hydrophobic hard fine particles to a toner so that a photoreceptor is abraded by the hard fine particles to prevent toner filming as disclosed in JP-A-2-89064. While effective to prevent filming, the hard particles added wear the surface of a photoreceptor, resulting in a serious reduction in durability of the photoreceptor. The hard fine particles also wear a cleaning blade to reduce the durability of the blade.

In order to meet the increasing demand for low potential and high development performance, several techniques for increasing mobility of a developer have been proposed. Among them is the use of a developer composed of a toner and a low-specific gravity, dispersion type carrier essentially comprising a resin and a magnetic powder. Since such a dispersion type carrier has a low true specific gravity and high insulating properties and can be regulated to have a small size with ease, a more dense and more uniform magnetic brush can be formed than in using a conventional coated type carrier, iron powder, etc. to afford images with improved quality, i.e., satisfactory density reproduction and freedom from noises such as streaks due to the magnetic brush. The developer using such a dispersion type carrier with high developing ability is effective particularly in a low-potential development system. On the other hand, however, due to its own characteristics of low specific gravity, high insulating properties, and small particle size, the dispersion type carrier is carried with a toner for development, and the carrier or a magnetic powder, etc. released from the carrier is apt to adhere on the surface of a photoreceptor. In addition, hard as it is, the magnetic powder tends to scratch the photoreceptor on cleaning, leading to image defects, such as white or black streaks, white or black spots, and the like.

With respect to the transfer step, it is important to generate a uniform electric field in the vicinity of a transfer material. For generation of an electric field, a corotron system has been widely employed for its simple mechanism and low cost. However, a corotron system involves a problem of ozone generation at the time of discharge. Ozone is now under strict control because of its harm to human bodies and, in addition, it contaminates a photoreceptor to cause image defects. Besides the problem of ozone, the corotron system has various disadvantages, such as a need of a high voltage source and a need of maintenance including periodical cleaning for removing deposited substances (e.g., a toner, silicone oil) and discharge products, and renewal of parts in case of burnout. Hence, a transfer system utilizing a bias roll system has been studied in expectation of no ozone generation, no need of maintenance and reduction in the requisite voltage.

In the bias roll transfer system, an electric field for transfer is formed through contact between a transfer material and a bias roll. Accordingly, the two members should be in contact with each other at a linear pressure of at least 5 g/cm for achieving transfer. However, the pressure exerted between a transfer material and a bias roll is ought to be imposed onto the transfer material, the photoreceptor, and the toner image on the photoreceptor. As a result, the toner particles on the photoreceptor tend to undergo agglomeration among themselves or deposition or caking onto the photoreceptor. It follows that transfer of the toner image to the transfer material is inhibited or is not achieved to cause image omissions.

In general development, a toner layer is thicker in the central portion of an image in case of a line image, or in the edge portion of an image in case of a solid image. Therefore, the image omission is liable to occur mostly in the center of a line image and in the edge and its vicinities of a solid image. The occurrence of image omissions is also influenced by the thickness or surface properties of a transfer material. Where a transfer material is thick, the pressure applied to a toner image on a photoreceptor increases so that the toner image is apt to undergo agglomeration or deposition. Where a transfer material has high surface smoothness, for example, in the case of an OHP sheet, the adhesion between toner particles and the transfer material becomes small, easily resulting in an image omission.

In order to increase transfer efficiency, it has been suggested to add various external additives to toner particles thereby to reduce the adhesion among toner particles or between toner particles and a photoreceptor. For example, external addition of inorganic compounds, such as silica, titania, and alumina, has been proposed as described in JP-A-59-226355, JP-A-61-23160, JP-A-63-118757, JP-A-2-1870, and JP-A-2-90175. As long as these techniques are applied to a non-contact transfer system, effects are somewhat expected by specifying the particle size of the additive and by providing adequate air gap between toner particles and a photoreceptor. However, where a transfer material is brought into contact with a bias roll, the inorganic compound, e.g., silica, titania or alumina, is buried in toner particles under pressure because of its hardness, resulting in a failure of performing the function as a transfer improving agent. Further, if part of a toner image remains on a photoreceptor as a result of an image omission, the buried inorganic fine powder also remains thereon to cause recesses or scratches on the photoreceptor.

JP-A-63-279264 teaches external addition of a mixed fine powder of a fatty acid metal salt and a resin aiming at stable supply of an additive while excluding high stress which might be imposed on the additive. This technique, when applied to the bias roll transfer system, is effective to decrease the frequency of image omissions to some extent by virtue of the external addition of a lubricating additive, but the effect reached is still insufficient. In addition, there arises a problem that the resin component in the mixed fine powder tends to be deposited on a photoreceptor.

JP-A-3-121462 suggests external addition of a silicone oil- or silicone varnish-treated fine powder so as to suppress the occurrence of image omissions in a bias roll transfer system. Although this technique produces effects in the initial stage, image omissions still take place in the course of long-term use particularly in copying on ordinary paper under a high temperature and high humidity condition or on OHP sheets under a low temperature and low humidity condition. Further, when stored in a low temperature and low humidity condition for a long period of time, the toner tends to become excessively chargeable, which will develop into a practical disadvantage of insufficient development, resulting in a reduction in image density. Furthermore, when the toner containing the silicone oil- or silicone varnish-treated fine powder is used in a high temperature and high humidity condition for a long period of time, cases are sometimes met in which a photoreceptor is scratched to cause black spots.

SUMMARY OF THE INVENTION

An object of the present invention is to provide a dry toner for developing an electrostatic latent image which satisfies fluidity, cleaning properties, environmental stability, and durability and which undergoes no toner filming on the surface of a photoreceptor, the surface of a carrier used in a two-component development system, and the surface of a charge-imparting member used in a one-component development system.

Another object of the present invention is to provide a dry toner for developing an electrostatic latent image which causes no reduction in working life of a photoreceptor or a cleaning blade.

A still another object of the present invention is to provide an electrophotographic method of image formation in which a satisfactory toner image can be obtained without involving insufficient cleaning or scratches on a cleaning member even in using a belt photoreceptor.

A further object of the present invention is to provide a method of image formation which does not cause a reduction in working life of a belt photoreceptor or a cleaning member.

A still further object of the present invention is to provide a method of image formation which affords a satisfactory image in a stable manner for an extended period of time.

A yet further object of the present invention is to provide a method of image formation including transfer of a toner image to a transfer material by a bias roll transfer system, in which occurrence of image omissions can be prevented or suppressed.

Other objects and effects of the present invention will be apparent from the following description.

As a result of extensive investigations, the present inventors have found that the above objects of the present invention are accomplished by using a developer containing, as an external additive, fine particles of a lubricant coated with an inorganic compound fine powder, and preferably those prepared from lubricant particles having a controlled small size coated with a hydrophobic inorganic compound fine powder.

The present invention relates to a dry toner for developing an electrostatic latent image comprising toner particles and fine particles of a lubricant coated with an inorganic compound fine powder. The coated lubricant fine particles are preferably those prepared by treating fine particles of a lubricant with a surface active agent and then coating the surface of the particles with an inorganic compound fine powder. The inorganic compound fine powder is preferably a hydrophobic inorganic compound fine powder.

The present invention also relates to a process for producing the above-mentioned dry toner, comprising the steps of: adhering an inorganic compound fine powder to the surface of fine particles of a lubricant having an average particle size of from 0.05 to 5 μm to obtain lubricant coated fine particles; and adding the coated lubricant fine particles to toner particles. The lubricant fine particles are preferably used in the form of an emulsion.

The present invention also relates to a two-component developer comprising a toner and a carrier containing at least a binder resin and a magnetic fine powder, the toner comprising toner particles and fine particles of a lubricant coated with an inorganic compound fine powder.

The present invention also relates to a method for forming an image comprising the steps of: forming an electrostatic latent image on a belt photoreceptor, developing the latent image with a developer to form a toner image; transferring the toner image to a transfer material; and removing the residual toner from the belt photoreceptor with a cleaning member, the developer comprising toner particles and fine particles of a lubricant coated with an inorganic compound fine powder.

The present invention also relates to a method for forming an image comprising the steps of: forming an electrostatic latent image on an electrostatic image carrier; developing the latent image with a developer to form a toner image; and transferring the toner image to a transfer material by means of a bias roll, the developer comprising toner particles containing at least a binder resin and a colorant and fine particles of a lubricant coated with an inorganic compound fine powder.

DETAILED DESCRIPTION OF THE INVENTION

Figure 1:
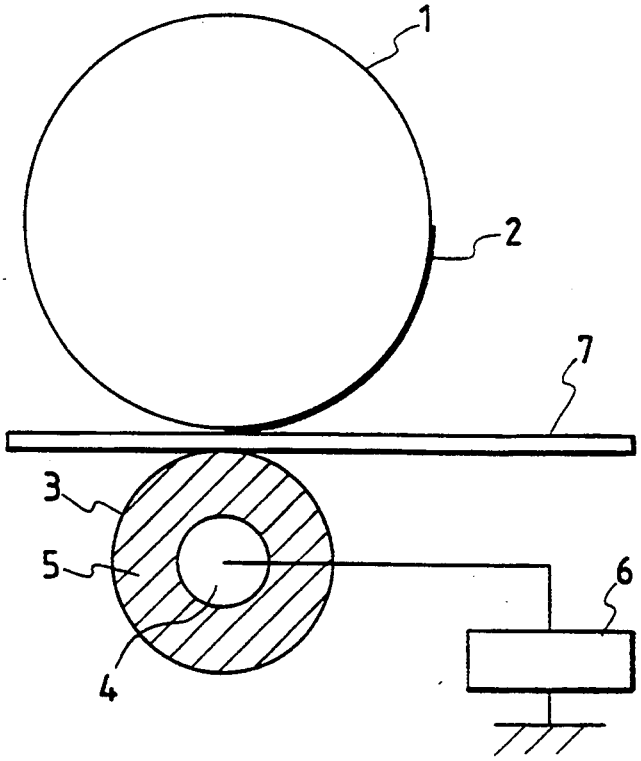
FIG. 1 is an illustration of a toner image transfer system using a bias roll.

Specific but non-limiting examples of the material constituting the lubricant fine particles which can be used in the present invention include waxes, such as microcrystalline wax, carnauba wax, paraffin wax, polyethylene wax, and polypropylene wax; fatty acid metal salts, such as barium enanthate, zinc enanthate, zinc caprylate, copper caprylate, calcium pelargonate, zinc pelargonate, copper pelargonate, lithium laurate, calcium laurate, magnesium laurate, zinc laurate, copper laurate, lithium myristate, magnesium myristate, lead myristate, lithium palmitate, calcium palmitate, magnesium palmitate, zinc palmitate, lithium stearate, calcium stearate, magnesium stearate, zinc stearate, barium oleate, calcium oleate, and zinc oleate; and fatty acid amides, such as stearamide, ethylenebisstearamide, and methylolstearamide. Among these, fatty acid metal salts and fatty acid amides are preferred, with stearic acid metal salts and stearic acid amides being more preferred. The material constituting the lubricant fine particles is not limited to the above examples.

Fine particles of these lubricants are preferably prepared in the form of an emulsion. The terminology "lubricant emulsion" as used hereinafter means a dispersion or suspension of fine lubricant particles in a liquid. The lubricant emulsion is preferably prepared by a process comprising emulsifying in a liquid-liquid system of a lubricant and a medium at a temperature above the melting point of the lubricant and then lowering the temperature to make a suspension. The particle size of the lubricant fine particles can be controlled by a concentration, stirring conditions, cooling conditions, use of a surface active agent, etc. The particle size is adjusted within a range generally of from 0.05 to 5 μm, and preferably of from 0.1 to 2 μm, in an emulsified state.

The lubricant emulsion is preferably prepared in the presence of a surface active agent. Examples of the surface active agents include carboxylate type anion surface active agents represented by fatty acid salts; sulfate type anion surface active agents represented by alkylsulfates; sulfonate type anion surface active agents represented by α-olefin sulfonates; phosphate type anion surface active agents represented by alkyl phosphates; cation surface active agents, such as amine salts, ammonium salts, imidazoline, imidazolium salts, and amine derivatives; amphoteric surface active agents, such as an N-alkylnitrilotriacetic acid and an N-alkylsulfobetaine; nonionic surface active agents; and special Si- or F-containing surface active agents. Among these, anion surface active agents are preferably used. The surface active agent is not limited to the above examples.

If desired, the lubricant emulsion may be prepared in the presence of a thickener, a stabilizer, a defoaming agent, etc.

Examples of the inorganic compound fine powder which can be used for coating the lubricant fine particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O(TiO_2)_n$, $Al_2O_3.2SiO_2$, $CaCO_3$, $MgCO_3$, $BaSO_4$, and $MgSO_4$. Among these, $SiO_2$, $TiO_2$, $Al_2O_3$, and $SnO_2$ are preferred, with $SiO_2$ and $TiO_2$ being more preferred.

The inorganic compound fine powder preferably has a particle size of from 0.005 to 0.5 μm, and more preferably from 0.005 to 0.02 μm.

The inorganic compound fine powder is preferably rendered hydrophobic so as to manifest its effects without depending on the environmental conditions, such as a high temperature and high humidity condition or a low temperature and low humidity condition. Examples of agents which can be used for rendering the inorganic compound fine powder hydrophobic include chlorosilanes, alkoxysilanes or silazanes, such as hexamethylenedisilazane, trimethylmethoxysilane, trimethylethoxysilane, dimethyldichlorosilane, trimethylchlorosilane, trimethylsilylmercaptan, vinyldimethylacetoxysilane, trimethylsilyl acrylate, and hexamethyldisiloxane; silicone oils, such as dimethylsilicone oil, amino-modified silicone oil, epoxy-modified silicone oil, and a higher fatty acid ester-modified silicone oil; saturated fatty acids, such as lauric acid, tridecanoic acid, myristic acid, palmitic acid, and stearic acid; substituted glycerols, such as trimethylolpropane, 1,2,3-butanetriol, and 2,3,4-hexanetriol; and titanium coupling agents, such as isopropyl triisostearoyl titanate, isopropyl trioctanoyl titanate, and isopropylisostearoyl diacryl titanate. These agents may be used either individually or in combination of two or more thereof. Among these, hexamethylenedisilazane and dimethyldichlorosilane are preferred. The agent for rendering the inorganic compound fine powder hydrophobic is not limited to the above examples.

The hydrophobic inorganic compound preferably has a hydrophobic index of 50 or more, and more preferably 65 or more.

The coverage of the inorganic compound fine powder on the lubricant fine particles preferably ranges from 5/95 to 85/15, more preferably from 20/80 to 70/30, by weight in terms of a lubricant fine particles/-hydrophobic inorganic compound fine powder.

Coating of the lubricant fine particles with the hydrophobic inorganic compound fine powder can be carried out by a method comprising soaking the hydrophobic inorganic compound fine powder in an alcohol, and adding a lubricant emulsion thereto and drying the mixture by spray drying, a fluidized bed process, etc. or a method comprising mixing the hydrophobic inorganic compound fine powder and a lubricant emulsion in a kneader, etc. followed by deaeration and drying. If necessary, a solvent may be used in the coating. The coating method is not limited to the above-mentioned methods, and any other method may be employed as long as the lubricant fine particles can be coated with the inorganic compound fine powder without inducing great change of the particle size of the lubricant (i.e., agglomeration). If desired, the resulting coated particles may be further ground, classified or sieved.

The coated lubricant fine particles thus prepared may contain agglomerates at a weak coherent strength as far as the agglomerates can be deagglomerated after being added to toner particles.

The coated lubricant fine particles preferably have an average particle size of not greater than 5 μm, and more preferably not greater than 3 μm. The proportion of particles greater than 5 μm, if any, in the coated lubricant fine particles is preferably not more than 10% (pop).

The thus prepared coated lubricant fine particles are added to toner particles preferably in an amount of from about 0.1 to 10%, and more preferably from about 0.2 to 2.0%, based on the total weight of the toner particles.

The toner particles which can be used in the present invention mainly comprise a binder resin and a colorant. The toner has an average particle size usually of not more than 30 μm, and preferably of from 3 to 20 μm. The toner may be a magnetic toner containing a magnetic material or a capsule toner.

Examples of the binder resins include homo- or copolymers of styrene or derivatives thereof, e.g., chlorostyrene; mono-olefins, e.g., ethylene, propylene, butylene, and isobutylene; vinyl esters, e.g., vinyl acetate, vinyl propionate, vinyl butyrate, and vinyl benzoate; α-methylene aliphatic monocarboxylic acid esters, e.g., methyl acrylate, ethyl acrylate, butyl acrylate, octyl acrylate, dodecyl acrylate, phenyl acrylate, methyl methacrylate, ethyl methacrylate, butyl methacrylate, and dodecyl methacrylate; vinyl ethers, e.g., vinyl methyl ether, vinyl ethyl ether, and vinyl butyl ether; and vinyl ketones, e.g., vinyl methyl ketone, vinyl hexyl ketone, and vinyl isopropenyl ketone.

Among them particularly typical binder resins are polystyrene, polyethylene, polypropylene, styrene-butadiene copolymers, styrene-alkyl acrylate copolymers, styrene-alkyl methacrylate copolymers, styrene-acrylonitrile copolymers, and styrene-maleic anhydride copolymers. In addition, polyester resin, polyurethane resins, epoxy resins, silicone resins, polyamide resins, modified rosin, and paraffin waxes are also employable.

Examples of the colorants include carbon black, Aniline Black, Aniline Blue, Chalcoyl Blue, Chrome Yellow, Ultramarine Blue, Du Pont Oil Red, Quinoline Yellow, Methylene Blue chloride, Phthalocyanine Blue, Malachite Green oxalate, lamp black, and Rose Bengale. In using a magnetic powder as a colorant, part of or the whole of the other colorants is replaced with a magnetic powder. Any of known magnetic powders, such as magnetite, ferrite, iron powder, and nickel powder, can be used.

The binder resin and the colorant are not limited to the above examples.

If desired, the toner particles of the present invention may further be compounded with other additives, such as fluidity-improving agents (e.g., silica fine particles), charge control agents, cleaning aids, and waxes.

Mixing of the coated lubricant fine particles and the toner particles can be carried out by means of, for example, a twin-cylinder mixer or a Henschel mixer.

The amount of the coated lubricant particles added to the toner particles is generally from 0.01 to 10.0% by weight, preferably from 0.1 to 5.0% by weight, based on the amount of the toner particles.

The inorganic compound fine powder-coated lubricant fine particles may be adhered merely physically or fixed loosely to the surface of the toner particles. The coated lubricant particles may cover the entire surface or a part of the surface of the toner particles. The coated lubricant particles on the toner particles may be partly agglomerated but preferably form a mono-particulate layer.

The toner which can be used in the image formation method of the present invention is not restricted by the mode of use. For example, the toner may be used in a two-component developer, a magnetic one-component developer containing a magnetic material or a capsule toner.

In the case where the toner is used in a two-component developer, the carrier to be used in combination is not particularly limited. Examples of the carriers include iron-based carriers, ferrite-based carriers, coated ferrite-based carriers, and magnetic powder-dispersed type carriers.

The mixing ratio of the toner and the carrier varies depending on the diameter of the carrier particles, and the amount of the toner should be larger, if the diameter of the carrier particles and that of the toner particles are closer to each other. The amount of the toner is generally from 0.1 to 50% by weight based on the total amount of the toner and the carrier.

The toner according to the present invention is used for development of an electrostatic latent image formed on an electrophotographic photoreceptor or an electrostatic recording medium (hereinafter sometimes inclusively referred to as an electrostatic latent image carrier). For example, an electrostatic latent image is electrophotographically formed on a photoreceptor comprising an inorganic photoconductive substance (e.g., selenium, zinc oxide, cadmium sulfide or amorphous silicon) or an organic photoconductive substance (e.g., a phthalocyanine pigment or a bisazo pigment), or an electrostatic latent image is formed on an electrostatic recording medium having a dielectric (e.g., polyethylene terephthalate) by means of a pin electrode, etc. The latent image thus formed is developed by magnetic brush development, cascade development, touch-down development, etc. to form a toner image, which is then transferred to a transfer material, such as paper, and fixed thereon to provide a copy. The residual toner on the electrostatic latent image carrier is cleaned by means of a cleaning blade, a web fur brush, a roll, etc. The toner of the present invention exhibits excellent cleaning properties particularly in a cleaning system using a blade.

According to the toner production process of the present invention, the lubricant fine particles have an extremely small particle size in an emulsion state with its size distribution being controlled within a very narrow range. When coated with an inorganic compound fine powder, the lubricant fine particles can be supplied in the form of a powder with its size approximating to the controlled size in the emulsion state.

Further, the coated lubricant fine particles exhibit a sufficient lubricating action to form a lubricating film on the surface of a photoreceptor, by which the frictional force between a cleaning blade and a photoreceptor is decreased to improve cleaning properties.

The image formation method using the above-described toner will be explained below.

An electrostatic latent image is formed on an electrostatic latent image carrier through an electrophotographic process or by means of a pin electrode, etc. The latent image carrier includes conventional latent image carriers, such as a selenium type photoreceptor, an organic photoreceptor, an amorphous silicon photoreceptor (these photoreceptors may have provided thereon an overcoat), and an electrostatic recording medium having a dielectric (e.g., polyethylene terephthalate). The thus formed electrostatic latent image is then developed with the above-described toner. The development system may be either a two-component development system or a one-component development system. The resulting toner image is transferred to a transfer material. In the image formation method according to the present invention, transfer of the toner image can be carried out by means of a bias roll.

FIG. 1 illustrates the transfer step using a bias roll. As shown in FIG. 1, the bias roll transfer system comprises electrostatic latent image carrier 1, on which toner image 2 is formed, and transfer roll 3 composed of metallic core 4 covered with semiconductive elastic layer 5. A bias voltage is applied to core 4 by power source 6 preferably at a current of from 0.5 to 30 $\mu$A and a voltage of from 100 to 2000 V. Semiconductive elastic layer 5 is an elastic body comprising a polyurethane or styrene-butadiene copolymer resin in which a conductive filler (e.g., carbon) is dispersed, etc. and has a volume resistivity of from $10^5$ to $10^{11}$ $\Omega$.cm.

Transfer material 7, such as paper, is inserted between electrostatic latent image carrier 1 and transfer roll 3 to conduct transfer. The transferred toner image is then fixed to provide a copy. The toner remaining on latent image carrier 1 is removed by cleaning with a blade, a web fur brush, a roll, and so on. As stated above, the present invention is especially suited to a cleaning system using a blade.

Figure 2:
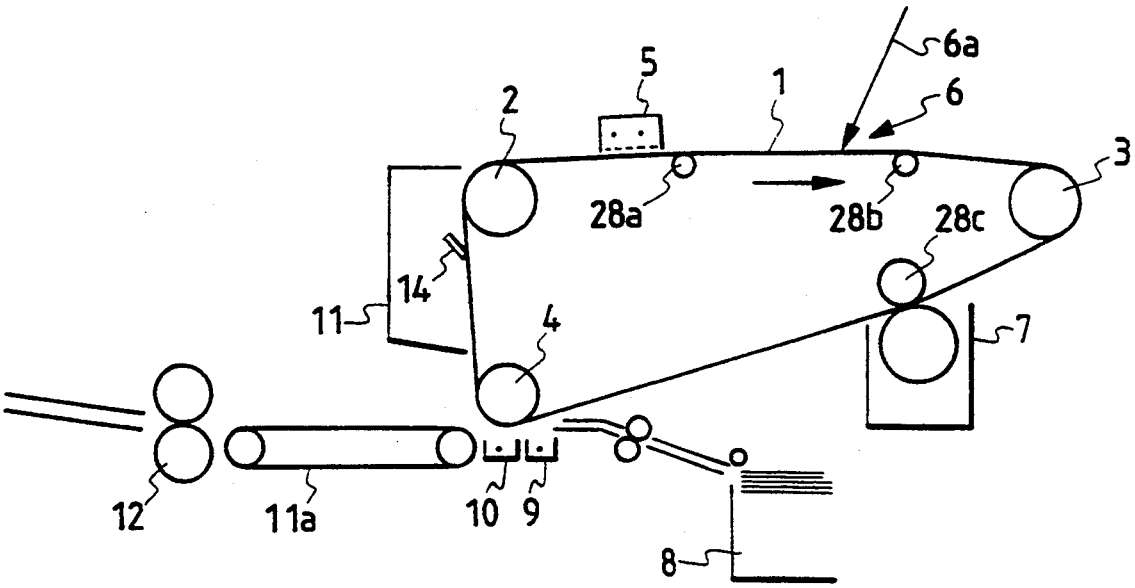
FIG. 2 is an illustration of an image forming apparatus using a belt photoreceptor.

FIG. 2 shows a schematic construction of an image forming apparatus using a belt photoreceptor. In FIG. 2, numeral 1 designates an endless belt photoreceptor installed onto a drive roll 2 and driven rolls 3 and 4. Arranged on the front surface of belt photoreceptor 1 are, from the upstream side in the direction of moving photoreceptor 1, charging unit 5 for charging photoreceptor 1; image exposing irradiating section 6 for forming a latent image by irradiating image exposing beam **6*a* onto the surface of photoreceptor 1; developing unit 7 for developing a toner image from the latent image; transfer unit 9 for transferring the toner image onto a sheet fed by sheet feeding means 8; separating unit 10 for separating the sheet having the toner image transferred thereon from photoreceptor 1; and cleaning unit 11. Numeral 11*a* designates a sheet-forwarding means for forwarding the sheet separated by separating unit 10 to fixing unit 12. Numerals 28*a*, 28*b* and 28*c*** designate other roll or bars.

Developing unit 7 contains two-component developer. Numeral 14 designates cleaning blade installed in cleaning unit 11 so as to press photoreceptor 1. Photoreceptor 1 preferably comprises organic photoconductive layer formed on endless base film. The photoconductive layer may be single-layer or function-separated multilayer photoconductive layer. The photoconductive layer contains electrically insulating binder such as polycarbonate resin and organic photoconductive material dispersed or dissolved therein. The organic photoconductive material may be composed of an organic charge generating pigment such as phthalocyanine and its derivatives and an organic charge transporting material such as a triarylamine compound.

The present invention is now illustrated in greater detail with reference to Examples and Comparative Examples, but it should be understood that the present invention is not deemed to be limited thereto. All the percents, parts, and ratios are by weight unless otherwise indicated.

Additives, designated A to I, to be externally added to toner particles in Examples and Comparative Examples were prepared as follows.

Preparation of Additive A

Two parts of hydrophobic silica ("R812" produced by Degussa; average particle diameter: 0.007 μm) were dispersed in 4 parts of ethanol and put in a kneader. Two parts of a 40% low-molecular weight polyethylene aqueous emulsion (average particle size: 0.5 μm; prepared by using a polyoxyethylene alkylallyl ether as a surface active agent) were added thereto dropwise while stirring. The dispersion was deaerated and dried while stirring to obtain hydrophobic silica-coated low-molecular polyethylene fine particles. The particles were ground in an automatic mortar.

Preparation of Additive B

Two parts of titanium dioxide ("P-25" produced by Degussa; average particle size: 0.021 μm) having been rendered hydrophobic with silicone oil were dispersed in 2 parts of ethanol and put in a kneader. Two parts of a 40% zinc stearate aqueous emulsion (average particle size: 1.0 μm) were added thereto dropwise while stirring. The dispersion was deaerated and dried while stirring to obtain hydrophobic titanium dioxide-coated zinc stearate fine particles. The particles were ground in an automatic mortar.

Preparation of Additive C

Two parts of hydrophobic silica ("RX200" produced by Nippon Aerosil Co., Ltd.; average particle diameter: 0.012 μm) were dispersed in 2 parts of ethanol, and 2 parts of a 20% zinc stearate aqueous emulsion (average particle size: 0.4 μm; prepared by using an α-olefin sulfonate as a surface active agent) was added thereto and dried by spray drying to obtain hydrophobic silica-coated zinc stearate fine particles. The particles were ground in an automatic mortar.

Preparation of Additive D

Two parts of hydrophobic silica (RX200) were dispersed in 2 parts of ethanol, and 4 parts of a 30% aqueous emulsion of ethylenebisstearamide (average particle size: 0.4 μm; prepared by using an α-olefin sulfonate as a surface active agent) was added thereto and dried by spray drying to obtain hydrophobic silica-coated ethylenebisstearamide fine particles. The particles were ground in an automatic mortar.

Preparation of Additive E

Low-molecular polyethylene ("200P" produced by Mitsui Petrochemical Industries, Ltd. density: 0.97) was freeze-ground and classified to cut coarse particles to obtain particles having an average diameter of 5 μm.

Preparation of Additive F

Zinc stearate was ground and classified to cut coarse particles to obtain particles having an average diameter of 8 μm.

Preparation of Additive G

Aluminum oxide powder having an average particle size of 0.013 μm was soaked in a 1% acetone solution of stearic acid and heated at 60° C. for 1 hour. Acetone was removed by drying to obtain aluminum oxide powder with its surface rendered lipophilic with stearic acid.

Preparation of Additive H

Hydrophilic silica-coated ethylenebisstearamide fine powder was prepared in the same manner as for additive D, except for replacing the hydrophobic silica with hydrophilic silica ("A200" produced by Nippon Aerosil Co., Ltd.; average particle size: 0.012 μm). The powder was then in an automatic mortar.

Preparation of Additive I

Two parts of hydrophobic silica (RX200) were dispersed in 4 parts of ethanol and put in a kneader. Dimethyl silicone oil ("KF-96" produced by Shin-Etsu Chemical Industry Co., Ltd.; viscosity: 100 cs) diluted with 4 parts of ethanol was added thereto dropwise with stirring, followed by deaerating and drying with stirring to obtain dimethyl silicone oil-treated hydrophobic silica fine particles.

EXAMPLE 1

| | |
|---|---|
| Styrene-butyl acrylate (80/20) copolymer | 100 parts |
| Carbon black ("R-330" produced by Cabot G.L. Inc.) | 10 parts |
| Low-molecular polypropylene ("Viscol 660P" produced by Sanyo Kasei Co., Ltd.) | 5 parts |
| Charge control agent ("Bontron P-51" Produced by Orient Kagaku Co., Ltd.) | 2 parts |

The above components were melt-kneaded in a Banbury mixer and, after cooling, finely ground in a jet mill, followed by classification to obtain toner particles having an average particle size of 10 μm.

A hundred parts of the toner particles were mixed with 1 part of titanium dioxide fine particles having an average particle size of 0.04 μm and 0.5 part of additive A in a Henschel mixer to prepare a toner.

Separately, ferrite core particles having an average particle size of 85 μm were coated with a silicone resin to obtain a carrier.

The toner and the carrier were mixed at a weight ratio of 3/97 to obtain a two-component developer.

EXAMPLE 2

Toner particles having an average particle size of 10 μm were prepared in the same manner as in Example 1, and 100 parts of the toner particles were mixed with 0.5 part of hydrophobic silica having an average particle size of 0.012 μm and 0.5 part of additive B in a Henschel mixer to prepare a toner.

The toner was mixed with the same carrier as used in Example 1 at a ratio of 3/97 to obtain a two-component developer.

EXAMPLE 3

Toner particles having an average particle size of 10 μm were prepared in the same manner as in Example 1, and 100 parts of the toner particles were mixed with 1.0 part of additive C in a Henschel mixer to prepare a toner.

The toner was mixed with the same carrier as used in Example 1 at a ratio of 3/97 to obtain a two-component developer.

EXAMPLE 4

Toner particles having an average particle size of 10 μm were prepared in the same manner as in Example 1, and 100 parts of the toner particles were mixed with 0.5 part of additive D in a Henschel mixer to prepare a toner.

The toner was mixed with the same carrier as used in Example 1 at a ratio of 3/97 to obtain a two-component developer.

EXAMPLE 5

| | |
|---|---|
| Styrene-butyl acrylate (80/20) copolymer | 100 parts |
| Carbon black ("Black Pearls 1300" produced by Cabot G.L. Inc.) | 10 parts |
| Low-molecular polypropylene (Viscol 660P) | 5 parts |
| Charge control agent ("Spiron Black TRH" Produced by Hodogaya Chemical Co., Ltd.) | 2 parts |

The above components were melt-kneaded in a Banbury mixer and, after cooling, finely ground in a jet mill, followed by classification in a classifier to obtain toner particles having an average particle size of 10 μm.

A hundred parts of the toner particles were mixed with 1.0 part of additive C in a Henschel mixer to prepare a toner.

Separately, ferrite core particles having an average particle size of 85 μm were coated with polymethyl methacrylate to obtain a carrier.

The toner was mixed with the carrier at a ratio of 3/97 to obtain a two-component developer.

EXAMPLE 6

Toner particles having an average particle size of 10 μm were prepared in the same manner as in Example 5, and 100 parts of the toner particles were mixed with 0.5 part of hydrophobic silica having an average particle size of 0.012 μm and 0.3 part of additive C in a Henschel mixer to prepare a toner.

The toner was mixed with the same carrier as used in Example 5 at a ratio of 3/97 to obtain a two-component developer.

EXAMPLE 7

| | |
|---|---|
| Styrene-butyl acrylate (80/20) copolymer | 100 parts |
| Magnetic powder ("EPT-1000" produced by Toda Kogyo Co., Ltd.) | 100 parts |
| Low-molecular polypropylene (Viscol 660P) | 5 parts |
| Charge control agent (Spiron Black TRH) | 2 parts |

The above components were mixed in a Henschel mixer and kneaded in a continuous kneading machine (two-cylinder type). After cooling, the mixture was finely ground in a jet mill and classified in a classifier to obtain toner particles having an average particle size of 10 μm.

A hundred parts of the toner particles were mixed with 0.5 part of hydrophobic silica having an average particle size of 0.012 μm and 0.5 part of additive C in a Henschel mixer to prepare a toner.

EXAMPLE 8

Toner particles having an average particle size of 10 μm were prepared in the same manner as in Example 7, and 100 parts of the toner particles were mixed with 0.5 part of hydrophobic silica having an average particle size of 0.012 μm and 0.5 part of additive D in a Henschel mixer to prepare a toner.

EXAMPLE 9

Toner particles having an average particle size of 10 μm were prepared in the same manner as in Example 7, and 100 parts of the toner particles were mixed with 0.5 part of hydrophobic silica having an average particle size of 0.012 μm and 0.5 part of additive H in a Henschel mixer to prepare a toner.

COMPARATIVE EXAMPLE 1

Toner particles having an average particle size of 10 μm were prepared in the same manner as in Example 1, and 100 parts of the toner particles were mixed with 0.5 part of hydrophobic silica in a Henschel mixer to prepare a toner.

The toner was mixed with the same carrier as used in Example 1 at a ratio of 3/97 to prepare a two-component developer.

COMPARATIVE EXAMPLE 2

Toner particles having an average particle size of 10 μm were prepared in the same manner as in Example 1, and 100 parts of the toner particles were mixed with 0.5 part of hydrophobic silica and 0.2 part of additive E in a Henschel mixer to prepare a toner.

The toner was mixed with the same carrier as used in Example 1 at a ratio of 3/97 to prepare a two-component developer.

COMPARATIVE EXAMPLE 3

Toner particles having an average particle size of 10 μm were prepared in the same manner as in Example 1, and 100 parts of the toner particles were mixed with 0.5 part of hydrophobic silica and 0.5 part of additive F in a Henschel mixer to prepare a toner.

The toner was mixed with the same carrier as used in Example 1 at a ratio of 3/97 to prepare a two-component developer.

COMPARATIVE EXAMPLE 4

Toner particles having an average particle size of 10 μm were prepared in the same manner as in Example 1, and 100 parts of the toner particles were mixed with 0.5 part of hydrophobic silica and 0.5 part of additive G in a Henschel mixer to prepare a toner.

The toner was mixed with the same carrier as used in Example 1 at a ratio of 3/97 to prepare a two-component developer.

COMPARATIVE EXAMPLE 5

Toner particles having an average particle size of 10 μm were prepared in the same manner as in Example 5, and 100 parts of the toner particles were mixed with 0.5 part of hydrophobic silica having an average particle size of 0.012 μm in a Henschel mixer to prepare a toner.

The toner was mixed with the same carrier as used in Example 5 at a ratio of 3/97 to prepare a two-component developer.

COMPARATIVE EXAMPLE 6

Toner particles having an average particle size of 10 μm were prepared in the same manner as in Example 7, and 100 parts of the toner particles were mixed with 0.5 part of hydrophobic silica in a Henschel mixer to prepare a toner.

Each of the developers obtained in the foregoing Examples and Comparative Examples was tested in accordance with the following test methods by using a copying machine "VIVACE 500" in Examples 1 to 4 and Comparative Examples 1 to 4, "FX-5039" in Examples 5 and 6 and Comparative Example 5, and "ABLE 3015" in Examples 7 to 9 and Comparative Example 6, all manufactured by Fuji Xerox Co., Ltd. The results obtained are shown in Tables 1 and 2 below.

1) Charging Properties:

The quantity of charge was measured with a blow-off meter ("TB 200" manufactured by Toshiba).

2) Cleaning Properties:

A toner image of a 5 cm wide black band was formed on the photoreceptor and, without being transferred, the toner image was wiped off with a cleaning blade. The cleaning test was repeated three times each comprising 999 cycles. The cleaning properties were evaluated according to the following rating system.

| | |
|---|---|
| G1 | The toner on the photoreceptor was completely cleaned without any problem. |
| G2 | Poor cleaning was slightly observed from the 2500th cycle. |
| G3 | Poor cleaning occurred between the 1500th cycle and the 2499th cycle. |
| G4 | Poor cleaning occurred between the 500th cycle and the 1499th cycle. |
| G5 | Poor cleaning occurred on or before the 499th cycle. |

3) Image Quality:

After obtaining 100,000 copies, the image quality of the copies and the surface condition of the photoreceptor were observed.

| | |
|---|---|
| G1 | During and after obtaining 100,000 copies, neither image defects, such as black spots, black streaks and fog, nor scratches on the photoreceptor was observed |
| G2 | Black streaks due to poor cleaning and black spots due to scratches on the photoreceptor developed from about the 800th copy. |
| G3 | Black steaks due to poor cleaning occurred from about the 1800th copy, and black spots due to scratches on the photoreceptor developed from about the 800th copy. |
| G4 | Black streaks due to filming developed from about the 1000th copy. |
| G5 | Black streaks due to filing developed from about the 800th copy. |
| G6 | Black streaks due to poor cleaning and black spots due to scratches on the photoreceptor developed from about the 500th copy. |

4) Wear of Photoreceptor:

After taking 100,000 copies, the wear (μm) of the photoreceptor was measured.

5) Reproducibility of Image Density:

After taking 1000 copies at 23° C. and 50% RH, the copying machine was allowed to stand under a high temperature and high humidity condition (30° C., 90% RH) or a low temperature and low humidity condition (10° C., 20% RH) for one day. The copying was resumed under the respective environmental condition, and the density of the image taken from a 1.0 gray solid original was measured with a Macbeth densitometer.

TABLE 1

| Example No. | Additive 1 (part) | Additive 2 (part) | Charge Quantity: Initial Stage (μC/g) | Charge Quantity: After Obtaining 100,000 Copies (μC/g) | Cleaning Properties | Image Quality | Wear of Photoreceptor (μm) |
|---|---|---|---|---|---|---|---|
| Example 1 | additive A (0.5) | titania (1.0) | 25 | 20 | G1 | G1 | <1.0 |
| Example 2 | additive B (0.5) | hydrophobic silica (0.5) | 16 | 13 | G2 | G1 | 1.0 |
| Example 3 | additive C (0.5) | — | 22 | 20 | G1 | G1 | <1.0 |
| Example 4 | additive D (0.5) | — | 18 | 15 | G1 | G1 | <1.0 |
| Comparative Example 1 | — | hydrophobic silica (0.5) | 20 | 12 | G5 | G2 | 30 |
| Comparative Example 2 | additive E (0.2) | hydrophobic silica (0.5) | 20 | 8 | G4 | G3 | 20 |
| Comparative Example 3 | additive F (0.5) | hydrophobic silica (0.5) | 12 | 6 | G3 | G4 | 10 |
| Comparative Example 4 | additive G (0.5) | hydrophobic silica (0.5) | 23 | 5 | G2 | G5 | 10 |
| Example 5 | additive C (1.0) | — | −23 | −20 | G1 | G1 | <1.0 |
| Example 6 | additive C (0.3) | hydrophobic silica (0.5) | −20 | −22 | G2 | G1 | 2.0 |
| Comparative Example 5 | — | hydrophobic silica (0.5) | −13 | −13 | G5 | G6 | 50 |

TABLE 2

| Example No. | Additive 1 (part) | Additive 2 (part) | Copy Density: 30° C., 90% RH | Copy Density: 10° C., 20% RH | Cleaning Properties | Image Quality | Wear of Photoreceptor (μm) |
|---|---|---|---|---|---|---|---|
| Example 7 | additive C (0.5) | hydrophobic silica (0.5) | 1.52 | 1.52 | G1 | G1 | <1.0 |
| Example 8 | additive D (0.5) | hydrophobic silica (0.5) | 1.48 | 1.48 | G1 | G1 | <1.0 |
| Example 9 | additive H (0.5) | hydrophobic silica (0.5) | 1.20 | 1.40 | G2 | G1 | 1.0 |
| Comparative | — | hydrophobic | 1.25 | 1.40 | G5 | G2 | 30 |

TABLE 2-continued

| Example No. | Additive 1 (part) | Additive 2 (part) | Copy Density 30° C., 90% RH | Copy Density 10° C., 20% RH | Cleaning Properties | Image Quality | Wear of Photoreceptor (μm) |
|---|---|---|---|---|---|---|---|
| Example 6 | | | | | | | |

EXAMPLE 10

| | |
|---|---|
| Styrene-butyl acrylate (80/20) copolymer | 100 parts |
| Carbon black (R-330) | 10 parts |
| Low-molecular polypropylene (Viscol 660P) | 5 parts |
| Charge control agent (Bontron P-51) | 2 parts |

The above components were melt-kneaded in a Banbury mixer and, after cooling, finely ground in a jet mill and classified in a classifier to obtain toner particles having an average particle size of 10 μm.

A hundred parts of the toner particles were mixed with 1 part of fine titanium dioxide particles having an average particle size of 0.04 μm and 0.5 part of additive A in a Henschel mixer to prepare a toner.

Separately, a dispersion type carrier was prepared as follows.

| | |
|---|---|
| Styrene-methyl acrylate (80/20) copolymer | 100 parts |
| Magnetite (EPT-1000) | 200 parts |
| Polyvinylidene fluoride ("KYNAR" produced by Penn Walt Co.) | 5 parts |

The above components were melt-kneaded in a pressure kneader, ground in a turbo-mill, and classified to obtain a carrier having an average particle size of 50 μm.

The toner and the carrier were mixed at a weight ratio of 3/97 to obtain a two-component developer.

EXAMPLE 11

A hundred parts of the same toner particles as prepared in Example 10, 0.5 part of hydrophobic silica having an average particle size of 0.012 μm, and 0.5 part of additive B were mixed in a Henschel mixer to prepare a toner. The resulting toner was mixed with the same carrier as used in Example 10 at a ratio of 3/97 to obtain a two-component developer.

EXAMPLE 12

A hundred parts of the same toner particles as prepared in Example 10 were mixed with 1.0 part of additive C in a Henschel mixer to prepare a toner. The resulting toner was mixed with the same carrier as used in Example 10 at a ratio of 3/97 to obtain a two-component developer.

EXAMPLE 13

A hundred parts of the same toner particles as prepared in Example 10 were mixed with 1.0 part of additive D in a Henschel mixer to prepare a toner. The resulting toner was mixed with the same carrier as used in Example 10 at a ratio of 3/97 to obtain a two-component developer.

COMPARATIVE EXAMPLE 7

A hundred parts of the same toner particles as prepared in Example 10 were mixed with 0.5 part of hydrophobic silica in a Henschel mixer to prepare a toner. The resulting toner was mixed with the same carrier as used in Example 10 at a ratio of 3/97 to obtain a two-component developer.

COMPARATIVE EXAMPLE 8

A hundred parts of the same toner particles as prepared in Example 10 were mixed with 0.5 part of hydrophobic silica in a Henschel mixer to prepare a toner.

Ferrite core particles having an average particle size of 50 μm were coated with a perfluoroalkyl acrylate-methyl methacrylate copolymer to prepare a carrier.

The toner and the carrier were mixed at a ratio of 3/97 to a two-component developer.

Each of the dry developers obtained in Examples 10 to 13 and Comparative Examples 7 and 8 was tested using a copying machine "ABLE 1301α" manufactured by Fuji Xerox Co., Ltd. according the following test methods. The results obtained are shown in Table 3 below.

1) Charging properties:

Measured in the same manner as in Example 1.

2) Toner Transfer Properties:

A 1.0 gray solid original was copied, and the resulting toner image was transferred to an adhesive tape to measure the amount of the toner.

3) Scratches on Photoreceptor:

The surface of the photoreceptor was observed with the naked eye.

4) Image Quality:

The copies were visually evaluated.

TABLE 3

| Example No. | Additive 1 (part) | Additive 2 (part) | Initial Charge Quantity (μC/g) | Toner Transfer Properties (mg/cm²) | Scratch on Photoreceptor | Image Quality | Carrier |
|---|---|---|---|---|---|---|---|
| Example 10 | additive A (0.5) | titania (1.0) | 26 | 0.62 | none | no problem | dispersion type |
| Example 11 | additive B (0.5) | hydrophobic silica (0.5) | 17 | 0.70 | none | no problem | dispersion type |
| Example 12 | additive C (0.5) | — | 21 | 0.68 | none | no problem | dispersion type |
| Example 13 | additive D (0.5) | — | 18 | 0.72 | none | no problem | dispersion type |
| Comparative Example 7 | — | hydrophobic silica (0.5) | 20 | 0.63 | a number of scratches developed | black streaks and black spots due to | dispersion type |

TABLE 3-continued

| Example No. | Additive 1 (part) | Additive 2 (part) | Initial Charge Quantity (μC/g) | Toner Transfer Properties (mg/cm²) | Scratch on Photoreceptor | Image Quality | Carrier |
|---|---|---|---|---|---|---|---|
| | | | | | (from the 500,000th copy) | scratches of the photoreceptor | |
| Comparative Example 8 | — | hydrophobic silica (0.5) | 18 | 0.31 | none | low image density (from the beginning) | coated type |

EXAMPLE 14

| | |
|---|---|
| Styrene-butyl acrylate (80/20) copolymer | 100 parts |
| Carbon black (R-330) | 10 parts |
| Low-molecular polyethylene (Viscol 660P) | 5 parts |
| Charge control agent (Bontron P-51) | 2 parts |

The above components were melt-kneaded in a Banbury mixer and, after cooling, finely ground in a jet mill and classified in a classifier to obtain toner particles having an average particle size of 10 μm.

A hundred parts of the toner were mixed with 1 part of fine titanium dioxide particles having an average particle size of 0.04 μm and 0.5 part of additive A in a Henschel mixer to prepare a toner.

Separately, ferrite core particles having an average particle size of 50 μm were coated with a silicone resin to obtain a carrier.

The toner and the carrier were mixed at a ratio of 3/97 to obtain a two-component developer.

EXAMPLE 15

A hundred parts of the same toner particles as prepared in Example 14, 0.5 part of hydrophobic silica having an average particle size of 0.012 μm, and 0.5 part of additive B were mixed in a Henschel mixer to prepare a toner. The resulting toner was mixed with the same carrier as used in Example 14 at a ratio of 3/97 to obtain a two-component developer.

EXAMPLE 16

A hundred parts of the same toner particles as prepared in Example 14 were mixed with 1.0 part of additive C in a Henschel mixer to prepare a toner. The resulting toner was mixed with the same carrier as used in Example 14 at a ratio of 3/97 to obtain a two-component developer.

EXAMPLE 17

A hundred parts of the same toner particles as prepared in Example 14 were mixed with 1.0 part of additive D in a Henschel mixer to prepare a toner. The resulting toner was mixed with the same carrier as used in Example 14 at a ratio of 3/97 to obtain a two-component developer.

COMPARATIVE EXAMPLE 9

A hundred parts of the same toner particles as prepared in Example 14 were mixed with 0.5 part of hydrophobic silica in a Henschel mixer to prepare a toner. The resulting toner was mixed with the same carrier as used in Example 14 at a ratio of 3/97 to obtain a two-component developer.

Each of the developers obtained in Examples 14 to 17 and Comparative Example 9 was tested in accordance with the following test methods using a copying machine "FX-5075" manufactured by Fuji Xerox Co., Ltd. in which a belt photoreceptor having an organic photosensitive layer was used. The results obtained are shown in Table 4 below.

1) Cleaning Properties:

Evaluated and rated in the same manner as in Example 1.

2) Wear of Cleaning Blade (μm):

After making 2000 copies, the cleaning blade was observed under a scanning electron microscope (×1000) to determine the wear.

3) Life of Cleaning Blade:

The number of copies obtained before any cleaning insufficiency due to wear of the cleaning blade, etc. was observed was determined.

4) Image Quality and Scratch on Photoreceptor:

After obtaining 200,000 copies, the image defects of the resulting copies and the surface condition of the photoreceptor were observed with the naked eye.

TABLE 4

| Example No. | Additive 1 (part) | Additive 2 (part) | Cleaning Properties | Wear of Blade (μm) | Life of Blade | Image Defect | Scratch on Photoreceptor |
|---|---|---|---|---|---|---|---|
| Example 14 | additive A (0.5) | titania (1.0) | G1 | ≦1 | 500,000 or more copies | none | none |
| Example 15 | additive B (0.5) | hydrophobic silica (0.5) | G1 | ≦1 | 500,000 or more copies | none | none |
| Example 16 | additive C (0.5) | — | G1 | ≦1 | 500,000 or more copies | none | none |
| Example 17 | additive D (0.5) | — | G2 | 2 | 300,000 copies* | none | none |
| Comparative Example 9 | — | hydrophobic silica (0.5) | G5 | 10 | 30,000 copies* | black streaks and black spots due to scratches on the photoreceptor | a number of scratches observed. Replaced after obtaining 50,000 |

TABLE 4-continued

| Example No. | Additive 1 (part) | Additive 2 (part) | Cleaning Properties | Wear of Blade (μm) | Life of Blade | Image Defect | Scratch on Photoreceptor |
|---|---|---|---|---|---|---|---|
| | | | | | | | copies because of peeling at the seams. |

*The blade had to be replaced because poor cleaning occured due to the wear of the blade, etc.

EXAMPLE 18

| | |
|---|---|
| Styrene-butyl acrylate (80/20) copolymer | 100 parts |
| Carbon black (R-330) | 10 parts |
| Low-molecular polyethylene (Viscol 660P) | 5 parts |
| Charge control agent (Bontron P-51) | 2 parts |

The above components were melt-kneaded in a Banbury mixer and, after cooling, finely ground in a jet mill and classified in a classifier to obtain toner particles having an average particle size of 10 μm.

A hundred parts of the toner were mixed with 1 part of fine titanium dioxide particles having an average particle size of 0.04 μm and 0.5 part of additive A in a Henschel mixer to prepare a toner.

Ferrite core particles having an average particle size of 85 μm were coated with a silicone resin to obtain a carrier.

The toner and the carrier were mixed at a ratio of 3/97 to obtain a two-component developer.

EXAMPLE 19

A two-component developer was prepared in the same manner as in Example 18, except for replacing additive A with additive C.

EXAMPLE 20

A two-component developer was prepared in the same manner as in Example 18, except for replacing additive A with additive D.

EXAMPLE 21

| | |
|---|---|
| Styrene-butyl acrylate (80/20) copolymer | 100 parts |
| Carbon black (Black Pearls 1300) | 10 parts |
| Low-molecular polyethylene (Viscol 660P) | 5 parts |
| Charge control agent (Spiron Black TRH) | 2 parts |

The above components were melt-kneaded in a Banbury mixer and, after cooling, finely ground in a jet mill and classified in a classifier to obtain toner particles having an average particle size of 10 μm.

A hundred parts of the toner were mixed with 0.5 part of hydrophobic silica having an average primary particle size of 0.012 μm and 0.5 part of additive A in a Henschel mixer to prepare a toner.

Ferrite core particles having an average particle size of 85 μm were coated with polymethyl methacrylate to obtain a carrier.

The toner and the carrier were mixed at a ratio of 3/97 to obtain a two-component developer.

COMPARATIVE EXAMPLE 10

A two-component developer was prepared in the same manner as in Example 18, except for using no additive A as an external additive to toner particles.

COMPARATIVE EXAMPLE 11

A two-component developer was prepared in the same manner as in Example 18, except for replacing additive A with additive I.

COMPARATIVE EXAMPLE 12

A two-component developer was prepared in the same manner as in Example 18, except for replacing additive A with additive F.

COMPARATIVE EXAMPLE 13

A two-component developer was prepared in the same manner as in Example 21, except for using no additive A as an external additive to toner particles.

COMPARATIVE EXAMPLE 14

A two-component developer was prepared in the same manner as in Example 21, except for replacing additive A with additive I.

Each of the two-component developers prepared in Examples 18 to 21 and Comparative Examples 10 to 14 was tested in accordance with the following test methods. The copying was conducted using a remodeled copying machine of "VIVACE 500" in Examples 18 to 20 and Comparative Examples 10 to 12 and a remodeled copying machine of "FX-5039" in Example 21 and Comparative Examples 13 and 14 under conditions shown in Table 5 below. The results obtained are shown in Table 6 below.

TABLE 5

| Copying Machine Used | Power Source | Transfer Voltage | Linear Pressure |
|---|---|---|---|
| Remodeled VIVACE 500 | constant voltage power | −400 V | 20 g/cm |
| Remodeled FX-5039 | constant voltage power | +400 V | 20 g/cm |

1) Charging Properties:

After taking 50,000 copies under a high temperature and high humidity condition (30° C., 90% RH) or a low temperature and low humidity condition (10° C. 20% RH), the charge quantity was measured with a blow-off meter (TB200).

2) Occurrence of Image Omission (%):

50,000 copies were taken from an original containing 1,500 letters, such as kanji (Chinese characters) and alphabets, under a high temperature and high humidity condition (30° C., 90% RH) or a low temperature and low humidity condition (10° C., 20% RH), and the percent occurrence of image omission was obtained. The percent occurrence up to 15 to 20% is regarded acceptable for practical use.

3) Wear of Photoreceptor (μm):

After making 50,000 copies, the wear of the photoreceptor was measured.

4) Image Quality:

50,000 copies were taken, and the image quality of the resulting copies and the surface conditions of the photoreceptor after the copying were observed and rated as follows.

| | |
|---|---|
| G1 | During and after obtaining 500,000 copies, neither image defects, such as black spots, black streaks and fog, nor scratches on the photoreceptor was observed. |
| G2 | Black streaks due to poor cleaning and black spots due to scratches on the photoreceptor developed from about the 900th copy. |
| G3 | Black spots due to scratches on the photoreceptor developed from about the 4300th copy. |
| G4 | Black streaks due to filming occurred from about the 1000th copy. |
| G5 | Black streaks due to poor cleaning and black spots due to scratches on the photoreceptor developed from about 500th copy. |

TABLE 6

| Example No. | Additive 1 (part) | Additive 2 (part) | Charge Quantity After Obtaining 50000 Copies 30° C., 90% RH (μc/g) | Charge Quantity After Obtaining 50000 Copies 10° C., 20% RH (μc/g) | Percent Occurrence of Image Omission 30° C., 90% RH (%) | Percent Occurrence of Image Omission 10° C., 20% RH (%) | Wear of Photo-receptor (μm) | Image Quality |
|---|---|---|---|---|---|---|---|---|
| Example 18 | additive A (0.5) | titania (0.5) | 19 | 23 | 12 | 16 | <1.0 | G1 |
| Example 19 | additive C (0.5) | " | 18 | 20 | 14 | 11 | <1.0 | G1 |
| Example 20 | additive D (0.5) | " | 22 | 24 | 17 | 19 | <1.0 | G1 |
| Comparative Example 10 | — | " | 21 | 19 | 75 | 82 | 5.0 | G2 |
| Comparative Example 11 | Additive I (0.5) | " | 20 | 16 | 30 | 17 | 1.0 | G3 |
| Comparative Example 12 | Additive F (0.5) | " | 19 | 20 | 40 | 45 | 2.8 | G4 |
| Example 21 | additive A (0.5) | hydrophobic silica (0.5) | −20 | −22 | 14 | 18 | 1.0 | G1 |
| Comparative Example 13 | — | hydrophobic silica (0.5) | −15 | −22 | 87 | 75 | 4.0 | G5 |
| Comparative Example 14 | Additive I (0.5) | hydrophobic silica (0.5) | −18 | −28 | 27 | 16 | 1.0 | G3 |

EXAMPLE 22

| | |
|---|---|
| Styrene-butyl acrylate (80/20) copolymer | 100 parts |
| Magnetic powder (EPT-1000) | 100 parts |
| Low-molecular polypropylene (Viscol 660P) | 5 parts |
| Charge control agent (Bontron P-51) | 2 parts |

The above components were dry blended in a Henschel mixer and melt-kneaded in an extruder. After cooling, the mixture was finely ground in a jet mill, followed by classification to obtain toner particles having an average particle size of 10 μm.

A hundred parts of the toner particles were mixed with 0.3 part of hydrophobic silica having an average primary particle size of 0.012 μm, and 0.5 part of additive B in a Henschel mixer to prepare a one-component developer.

EXAMPLE 23

| | |
|---|---|
| Styrene-butyl acrylate (80/20) copolymer | 100 parts |
| Magnetic powder (EPT-1000) | 100 parts |
| Low-molecular polypropylene (Viscol 660P) | 5 parts |
| Charge control agent (Spiron Black TRH) | 2 parts |

The above components were dry blended in a Henschel mixer and melt-kneaded in an extruder. After cooling, the mixture was finely ground in a jet mill, followed by classification to obtain toner particles having an average particle size of 10 μm.

A hundred parts of the toner particles were mixed with 0.5 part of hydrophobic silica having an average primary particle size of 0.012 μm and 0.5 part of additive A in a Henschel mixer to prepare a one-component developer.

EXAMPLE 24

A one-component developer was prepared in the same manner as in Example 23, except for replacing additive A with additive C.

EXAMPLE 25

A one-component developer was prepared in the same manner as in Example 23, except for replacing additive A with additive D.

COMPARATIVE EXAMPLE 15

A one-component developer was prepared in the same manner as in Example 22, except for using only the hydrophobic silica particles (0.3 part) as an external additive.

COMPARATIVE EXAMPLE 16

A one-component developer was prepared in the same manner as in Example 22, except for replacing additive A with additive I.

COMPARATIVE EXAMPLE 17

A one-component developer was prepared in the same manner as in Example 23, except for only using 0.5 part of the hydrophobic silica particles as an external additive.

COMPARATIVE EXAMPLE 18

A one-component developer was prepared in the same manner as in Example 23, except for replacing additive A with additive I.

COMPARATIVE EXAMPLE 19

A one-component developer was prepared in the same manner as in Example 23, except for replacing additive A with additive F.

Each of the one-component developers prepared in Examples 22 to 25 and Comparative Examples 15 to 19 was tested in accordance with the following test methods. The copying was conducted using a remodeled copying machine of "VIVACE 200" in Example 22 and Comparative Examples 15 and 16 and a remodeled copying machine of "ABLE 3015" in Examples 23 to 25 and Comparative Examples 17 to 19 under conditions shown in Table 7 below. The results obtained are shown in Table 8 below.

TABLE 7

| | Power | Transfer | Linear |
|---|---|---|---|
| Copying Machine Used | Source | Current | Pressure |
| Remodeled VIVACE 200 | constant current power | −3.5 μA | 20 g/cm |
| Remodeled ABLE 3015 | constant current power | +3.0 μA | 20 g/cm |

1) Image Density:

After taking 10,000 copies under a high temperature and high humidity condition (30° C., 90% RH) or a low temperature and low humidity condition (10° C. 20% RH), the image density of the copy taken from a 1.0 gray solid original was measured with a Macbeth densitometer.

2) Percent Occurrence of Image Omission (%):

10,000 copies were taken from an original containing 1500 letters, such as kanji (Chinese characters) and alphabets, under a high temperature and high humidity condition (30° C., 90% RH) or a low temperature and low humidity condition (10° C., 20% RH), and the percent occurrence of image omission was determined. The percent occurrence up to 15 to 20% is regarded acceptable for practical use.

3) Wear of Photoreceptor (μm ):

After making 10,000 copies, the wear of the photoreceptor was measured.

4) Image Quality:

10,000 copies were taken, and the image quality of the resulting copies and the surface conditions of the photoreceptor after the copying were observed and rated as follows.

| | |
|---|---|
| G1 | During and after obtaining 10,000 copies, neither image defects, such as black spots, black streaks and fog, nor scratches on the photoreceptor was observed. |
| G2 | Black streaks due to poor cleaning and black spots due to scratches on the photoreceptor developed from about the 200th copy. |
| G3 | Black spots due to scratches on the photoreceptor developed from about the 9000th copy. |
| G4 | Black streaks due to filming occurred from about the 900th copy. |
| G5 | Black streaks due to poor cleaning and black spots due to scratches on the photoreceptor developed from about 90th copy. |

TABLE 8

| Example No. | Additive 1 (part) | Additive 2 (part) | Image Density After Obtaining 10000 Copies 30° C., 90% RH | Image Density After Obtaining 10000 Copies 10° C., 20% RH | Percent Occurrence of Image Omission 30° C., 90% RH (%) | Percent Occurrence of Image Omission 10° C., 20 RH (%) | Wear of Photoreceptor (μm) | Image Quality |
|---|---|---|---|---|---|---|---|---|
| Example 22 | additive B (0.5) | hydrophobic silica (0.3) | 1.14 | 1.10 | 14 | 16 | <1.0 | G1 |
| Comparative Example 15 | — | hydrophobic silica (0.3) | 0.93 | 0.76 | 75 | 80 | 1.8 | G2 |
| Comparative Example 16 | additive D (0.5) | hydrophobic silica (0.3) | 1.15 | 0.84 | 28 | 19 | 1.0 | G3 |
| Example 23 | additive A (0.5) | hydrophobic silica (0.5) | 1.10 | 1.12 | 18 | 16 | <1.0 | G1 |
| Example 24 | additive B (0.5) | hydrophobic silica (0.5) | 1.25 | 1.22 | 15 | 16 | <1.0 | G1 |
| Example 25 | additive C (0.5) | hydrophobic silica (0.5) | 1.15 | 1.20 | 18 | 20 | 1.0 | G1 |
| Comparative Example 17 | — | hydrophobic silica (0.5) | 0.90 | 0.72 | 89 | 88 | 2.5 | G4 |
| Comparative Example 18 | additive D (0.5) | hydrophobic silica (0.5) | 1.22 | 0.95 | 32 | 16 | 1.5 | G3 |
| Comparative Example 19 | additive E (0.5) | hydrophobic silica (0.5) | 1.10 | 1.11 | 38 | 44 | 2.0 | G5 |

As described above, the dry toner according to the present invention which contains inorganic compound fine powder-coated lubricant fine particles as an external additive exhibits excellent fluidity and excellent cleaning properties as well as excellent environmental stability and durability. It does not cause toner filming on the surface of a photoreceptor, a carrier (to be used in a two-component development system) or a charge-imparting member (to be used in a one-component development system).

The coated lubricant particles act as fluidity-improving agent to reduce a frictional force thereby making it possible to use a toner compounded with a hard inorganic oxide fine powder or a magnetic toner containing a magnetic powder, e.g., magnetite in a copying machine using an organic photoreceptor. Hence, the toner of the present invention is particularly effective when applied to a belt photoreceptor having an organic photoconductive layer which is subject to a high load on being cleaned.

Further, where low-molecular weight polyethylene is used as the lubricant fine particles, the lubricant particles form a thin film on the surface of a fixed image to thereby provide a toner image with reduced friction and increased abrasion strength. That is, the fixed toner image will not be scratched by a roller, etc. in double side copying or while being carried in a copying machine.

According to the toner production process of the present invention, lubricant particles having a small particle size with a very narrow controlled size distribution can be used.

According to the image formation method of the present invention, the microfine lubricant particles form a thin and uniform parting film on the surface of a photoreceptor so that the adhesion of toner particles to the photoreceptor can markedly be reduced. As a result, image omissions which frequently take place when a transfer step is carried out by means of a bias roll can be eliminated or reduced. Further, the hydrophobic inorganic compound fine powder-coated lubricant fine particles act as a fluidity-improving agent to produce an effect of reducing a frictional force. Thus, wear of an organic photoreceptor can be minimized even in the case of using a hard inorganic oxide fine powder or a magnetic powder, e.g., magnetite.

Further, where low-molecular weight polyethylene is used as the lubricant fine particles, the lubricant particles form a thin film on the surface of a fixed image thereby to provide a toner image with reduced friction and increased abrasion strength. That is, the fixed toner image will not be scratched by a roller, etc. during double side copying or while being carried in a copying machine.

While the invention has been described in detail and with reference to specific examples thereof, it will be apparent to one skilled in the art that various changes and modifications can be made therein without departing from the spirit and scope thereof.

What is claimed is:

1. A dry toner for developing an electrostatic latent image comprising toner particles and fine particles of a lubricant coated with an inorganic compound fine powder.

2. A dry toner as claimed in claim 1, wherein said coated lubricant fine particles are obtained by treating fine particles of a lubricant with a surface active agent and then coating the surface of the particles with an inorganic compound fine powder.

3. A dry toner as claimed in claim 1, wherein said inorganic compound fine powder is a hydrophobic inorganic compound fine powder.

4. A process for producing a dry toner for developing an electrostatic latent image, comprising the steps of: adhering an inorganic compound fine powder to the surface of lubricant fine particles having an average particle size of from 0.05 to 5 μm to obtain coated lubricant fine particles; and adding said coated lubricant fine particles to toner particles.

5. A process as claimed in claim 4, wherein said lubricant fine particles are in the form of an emulsion.

6. A two-component developer comprising a toner and a carrier containing at least a binder resin and a magnetic fine powder, said toner comprising toner particles and lubricant fine particles coated with an inorganic compound fine powder.

7. A method for forming an image comprising the steps of: forming an electrostatic latent image on a belt photoreceptor; developing said latent image with a developer to form a toner image; transferring said toner image to a transfer material, and removing the residual toner from said belt photoreceptor with a cleaning member, said developer comprising toner particles and lubricant fine particles coated with an inorganic compound fine powder.

8. A method for forming an image as claimed in claim 7, wherein said belt photoreceptor is an organic photoreceptor.

9. A method for forming an image comprising the steps of: forming an electrostatic latent image on an electrostatic latent image carrier; developing said latent image with a developer to form a toner image; and transferring said toner image to a transfer material by means of a bias roll, said developer comprising toner particles containing at least a binder resin and a colorant and fine particles of a lubricant coated with an inorganic compound fine powder.

10. A method as claimed in claim 9, wherein said lubricant fine particles are prepared from a lubricant emulsion containing a surface active agent.

11. A method as claimed in claim 9, wherein said inorganic compound fine powder is a hydrophobic inorganic compound fine powder.

12. A method as claimed in claim 9, wherein said toner particles contains at least a binder resin and a magnetic powder.

* * * * *